United States Patent [19]

Schosek

[11] 4,251,057

[45] Feb. 17, 1981

[54] LEVELING MEANS FOR AN UNDERGROUND PIPE INSTALLER DEVICE

[76] Inventor: William O. Schosek, 7942 Marx Dr., North Fort Myers, Fla. 33903

[21] Appl. No.: 68,153

[22] Filed: Aug. 20, 1979

[51] Int. Cl.[3] ..... E21B 19/00

[52] U.S. Cl. ..... 254/29 R

[58] Field of Search ..... 254/29 R, 126; 248/678, 248/649, 188.4

[56] References Cited

U.S. PATENT DOCUMENTS

| | | | |
|---|---|---|---|
| 2,656,148 | 10/1953 | Fladung | 254/29 R |
| 3,907,253 | 9/1975 | Schosek | 254/29 R |
| 3,916,636 | 11/1975 | Wilhelm | 254/29 R |
| 4,024,721 | 5/1977 | Takada et al. | 254/29 R |

*Primary Examiner*—Robert C. Watson

*Attorney, Agent, or Firm*—Alfred E. Wilson

[57] ABSTRACT

A leveling structure incorporated in an underground pipe installer device comprised of a jack positioned relative to a first end portion of the pipe installer device to selectively raise or lower the first end a desired amount about a pivot, located adjacent to a second end of the device. A first, vertically movable portion of the jack is fixed relative to a main longitudinally extending main frame which carries drive jaws operated by a suitable fluid operated cylinder and piston assembly utilized to drive a rod through the ground to form a hole into which a pipe or the like is withdrawn into an installed position. A second portion of the jack is pivoted to a rear end portion of a base structure which is, in turn, pivotally attached at its forward end relative to a forward end portion of the main frame; and a vertically extending screw rod is threaded through a nut carried in the upper end of the first jack portion with a lower end portion, rotatably captivated to a top end of the second jack portion.

7 Claims, 4 Drawing Figures

LEVELING MEANS FOR AN UNDERGROUND PIPE INSTALLER DEVICE

BACKGROUND OF THE PRESENT INVENTION

It is often necessary to install an underground pipe between two given points such as the opposed sides of a finished street or driveway, for example. It is routine procedure to provide an operating trench on one side and a target trench on the opposed side, and a pipe installer device is properly positioned in the operating trench.

A first rod length is manually inserted through drive jaw means, reciprocatively journaled between side walls of a main longitudinal frame of the pipe installer, incorporating the leveling means of the present invention. The first rod length is engaged by the jaws and driven by appropriate cylinder and piston means toward the target trench. A sufficient plurality of rod lengths are coupled respectively to preceding rod lengths and driven forwardly until the leading tip end of the first rod length emerges into the target trench.

An adapter is attached between the tip end and a pipe to be permanently positioned in the formed hole. For this purpose, the direction of movement is reversed to pull the rods with the pipe attached thereto backwardly through the hole, formed by the rod, until the leading tip end of the pipe emerges into the operating trench.

The above described operations are generally conventional, however, it is essential to level the installer and rod relative to the street, driveway or the like prior to initiating movement of the rod in the hole forming operation. In the past, this was done by attempting to level the trench bottom supporting the installer device or by using shims to level the device relative to the trench bottom.

Therefore, it is a principal object of the present invention to provide a jack means at a first end portion of the pipe installer device which is positioned relative to a main longitudinal length thereof and pivot means connecting to a base portion whereby the main longitudinal length carrying the drive jaws and hole forming rod may be angled upwardly or downwardly in a generally vertical plane relative to the base seated in the bottom of an operating trench.

DESCRIPTION OF A PREFERRED EMBODIMENT

Figures 1, 2, 3, 4:
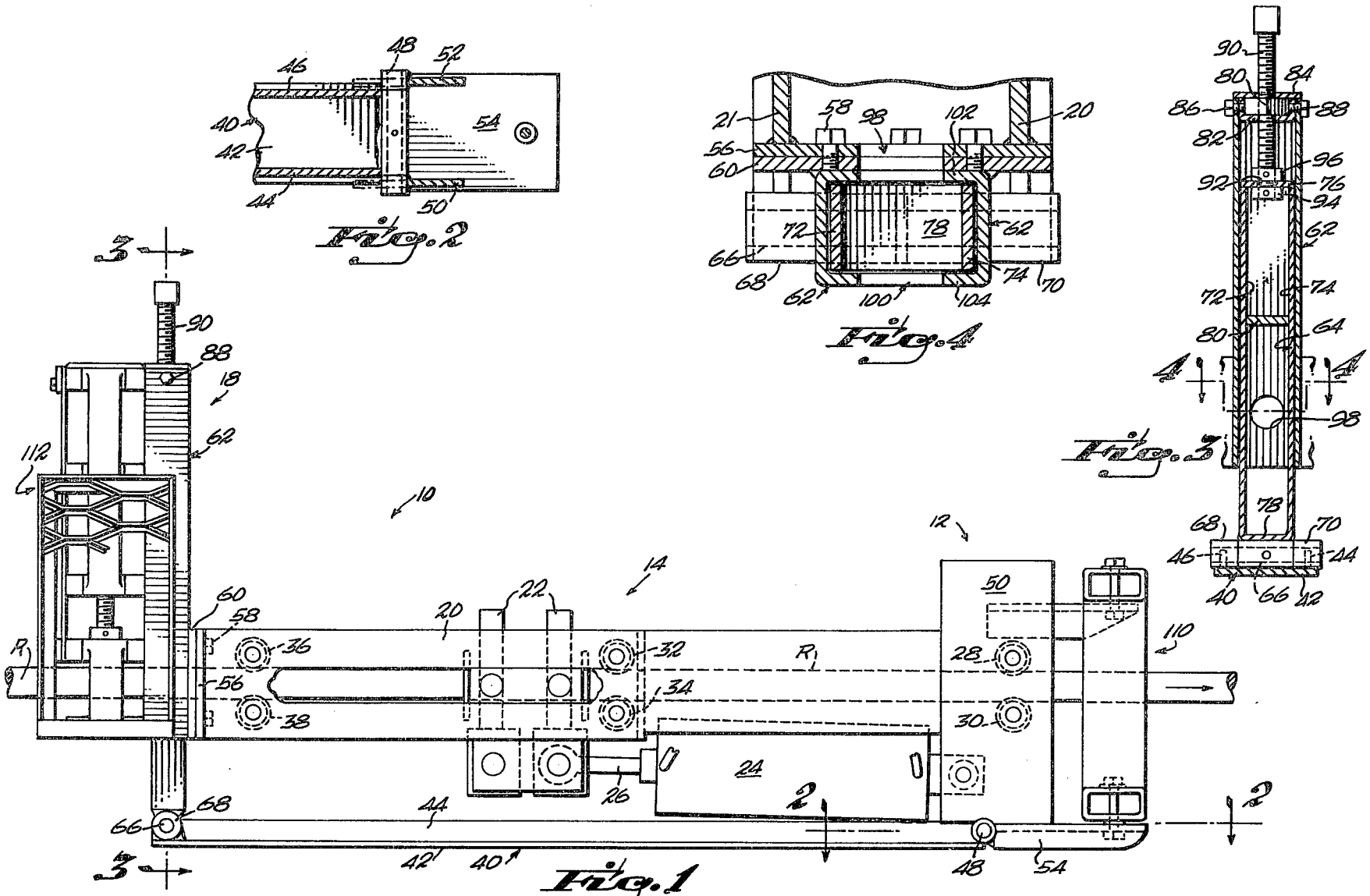
FIG. 1 is a side elevational view of an underground pipe installer device incorporating the jack means of the present invention.
FIG. 2 is a fragmentary sectional view taken along line 2—2 of FIG. 1.
FIG. 3 is a vertical sectional view taken along line 3—3 of FIG. 1.
FIG. 4 is an enlarged transverse sectional view taken along line 4—4 of FIG. 3.

With reference to the drawings in which like reference characters designate like or corresponding parts throughout the various views, and with particular reference to FIG. 1, the underground pipe installer device of the present invention, designated generally at 10, includes a forward end portion 12, a main central length 14 and a rear end portion 16 including the jack device of the present invention, indicated generally at 18.

A hole forming rod R, extends longitudinally between a pair of parallel side walls 20, 21 and a pair of drive jaws 22, forming no part of the present invention, are operably driven by a fluid operated cylinder and piston assembly 24, 26 to selectively advance the rod R in a hole forming operation, and to retract the rod R from its fully extended position, with a pipe attached thereto, in the pipe installing operation. The rod R is supported and guided in its longitudinal movements between pairs of guide rollers such as 28, 30, 32, 34 and 36, 38 journaled between the pair of side walls 20, 21. In this manner, the rod R is precisely controlled relative to the main central length 14 during the hole forming and pipe installing operations.

However, the main central length 14 must be leveled relative to the surface under which the pipe is to be installed and to the target trench. To this end, a main support base structure 40, comprised of a base plate 42and a pair of stiffening ribs 44, 46, is pivoted at 48 relative to a pair of vertical side plates 50, 52, fixed as by welding between respective forward ends of side walls 20, 21 and a separate forward end support base portion 54.

At their rear ends, side walls 20, 21 are fixed to a cross plate 56, which is bolted at 58 to a like plate 60, fixed as by welding to a vertical rectangular tube 62 which comprises an outside portion of the jack 18.

With particular reference to FIG. 3, an elongated generally rectangular assembly 64 is slidably engaged within the jack tube 62. At its lower end, the inside jack assembly 64 is pivotally attached by a pin 66 to a pair of collars 68, 70 fixed as by welding to a rear end of the main support base 40. Rectangular assembly 64 is comprised of a pair of parallel, vertical side rails 72, 74 interconnected at respective top and bottom ends by cross portions 76, 78 and an intermediate brace 80.

A nut 80 incaptivated in the top open end of rectangular tube 62 in a U-bracket 82, welded to a top cover plate 84. The U-bracket 82, cover plate 84 and nut 80 are fixed in place by bolts 86, 88. Threaded downwardly in engagement through nut 80 is an elongated screw rod 90 which is captivated at its lower end for rotational movement in a hole 92 provided in the top cross member 76 of inner jack assembly 64 by inner and outer collars 94, 96, pinned to the inner end portion of screw rod 90 on opposed sides of said top member 76. Concentric holes 98, 100 are provided through cross plates 56, 60 and a forward wall 102 of tube 62 and a rear wall 104 thereof for through passage of rod R.

Therefore selective manipulation of screw rod 90 will cause upward or downward pivotal movement of the main support base 40 about pivot 48. A level may be placed along the top of rod R and the screw rod 90 manipulated to establish a perfectly level positioning of rod R, for example, prior to initiating movement of the rod R in the hole forming operation, or, the main support base 40 may be angled to accommodate as desired angle of penetration into the ground.

The front end structure indicated generally at 110 and the rear end structure indicated generally at 112 form no part of the present invention and function independently thereof and are, therefore, not illustrated in detail or herein described.

I claim:

1. A leveling device for an underground pipe installer of a type including an elongated generally longitudinally extending main central length with first and second end portions, reversible drive jaw means, reciprocally journaled in said main central length to engage and drive a rod through the ground for a predetermined distance to form a hole into which a pipe or the like, attached to a leading end of the rod, is withdrawn into an installed position, means to reciprocally drive the jaws and guide roller means to direct the rod in its movements in a generally longitudinal parallel relation to the main central length, the leveling device comprising, an elongated, generally longitudinally extending main support base pivotally attached at a first end relative to a bottom portion of the first end portion of the main central length, a generally upright jack means including a first generally upright portion with fixed attachment means to the second end portion of the main central length, and a second generally upright portion slidably positionable relative to said first generally upright portion and including a lower end pivotal attachment to a second end of said main support base, and means to adjust the position of said second generally upright portion relative to said first generally upright portion in a generally upright relationship.

2. The leveling device as defined in claim 1 wherein said main central length first end portion comprises a forward leading end portion thereof and said main central length second end portion comprises a rear end thereof.

3. The leveling device as defined in claim 2 wherein said jack means first generally upright portion comprises a tube, generally rectangularly configurated in cross section.

4. The leveling device as defined in claim 3 wherein said jack means second generally upright portion comprises an elongated generally rectangular frame comprised of a pair of generally upright opposed side wall portions connected respectively at top and bottom ends by top and bottom cross portions, said frame being sized for sliding engagement within said tube.

5. The leveling device as defined in claim 4 including hole means through said jack means and attachment means for free passage therethrough of the rod.

6. The leveling device as defined in claim 5 wherein said means to adjust comprises a nut positioned within a top end of said tube and means to captivate said nut therein against rotational movement, an elongated screw rod engaged through said nut and including a top end portion extending upwardly and outwardly of said tube with a distal end portion, configurated for engagement by an appropriate tool, and an inner end portion extending loosely through a hole in said top cross portion and means to captivate said inner end through said top cross portion hole.

7. The leveling device as defined in claim 6 wherein said means to captivate comprises a pair of collars pinned to said inner end respectively above and below said top cross portion.

* * * * *